United States Patent [19]

Holt et al.

[11] 4,444,022

[45] * Apr. 24, 1984

[54] WATER HEATING SYSTEM

[75] Inventors: Ronald A. Holt, Delmont; Robert B. Whitesides, Murrysville, both of Pa.

[73] Assignee: Aluminum Company of America, Pittsburgh, Pa.

[ * ] Notice: The portion of the term of this patent subsequent to May 11, 1999 has been disclaimed.

[21] Appl. No.: 370,722

[22] Filed: Apr. 22, 1982

Related U.S. Application Data

[63] Continuation-in-part of Ser. No. 224,146, Jan. 12, 1981, Pat. No. 4,328,683.

[51] Int. Cl.[3] ..... F25B 27/02

[52] U.S. Cl. ..... 62/238.6; 237/2 B

[58] Field of Search ..... 62/238.6; 237/2 B

[56] References Cited

U.S. PATENT DOCUMENTS

| | | | |
|---|---|---|---|
| 1,119,063 | 12/1914 | Burnap . | |
| 1,765,136 | 6/1930 | Drane . | |
| 2,396,338 | 3/1946 | Newton | 257/3 |
| 2,575,478 | 11/1951 | Wilson | 237/1 |
| 2,689,090 | 9/1954 | Wetherbee et al. | 237/1 |
| 3,152,442 | 10/1964 | Rowekamp | 60/26 |
| 4,044,948 | 8/1977 | Bottum et al. | 237/1 A |
| 4,049,407 | 9/1977 | Bottum | 62/2 |
| 4,073,285 | 2/1978 | Wendel | 126/271 |
| 4,173,872 | 11/1979 | Amthor | 62/238 |
| 4,203,422 | 5/1980 | Bottum | 126/417 |
| 4,328,683 | 5/1982 | Whitesides et al. | 62/238.6 |
| 4,356,706 | 11/1982 | Baumgarten | 62/238.6 |

*Primary Examiner*—Lloyd L. King

*Attorney, Agent, or Firm*—Elroy Strickland

[57] ABSTRACT

A container construction and combination in which a container for confining water or other fluid to be heated is provided with a metal heat exchanger disposed within the container. The heat exchanger is comprised of a single wall tube structure having outwardly directed fins extending in a vertical direction within the container. Means are provided for connecting an upper end of the heat exchanger to a source of heated refrigerant through an upper opening provided in a side wall of the container, the refrigerant being vaporized when heated, and condensed when cooled in the heat exchanger. The disposition of the heat exchanger permits the force of gravity to remove condensed refrigerant from the heat exchanger. Means are provided for returning condensed refrigerant to the source of heated refrigerant from a lower end of the heat exchanger and through a lower opening in the side wall of the container. And means are provided to free the combination of galvanic action when a fluid to be heated is present in the container.

5 Claims, 9 Drawing Figures

WATER HEATING SYSTEM

CROSS-REFERENCE TO RELATED APPLICATIONS

This is a continuation-in-part of U.S. application Ser. No. 224,146, filed Jan. 12, 1981, now U.S. Pat. No. 4,328,683.

BACKGROUND OF THE INVENTION

The present invention relates generally to the heating of water for commercial and/or home use, and particularly to a water heating system that is free of the corrosive effects of galvanic action, thereby providing the system with a long life. However, fluids other than water can cause corrosion problems in systems employing metals that are galvanically different. Hence, the invention is not limited to the heating of water only.

A substantial amount of art exists which discloses the use of heat sources, such as solar heaters, to heat water within a container or tank structure, the heat source being connected in fluid communication with a heat exchanger (condenser) located within the container. This art includes the use of ordinary glass-lined, hot water tanks having a heat exchange unit within the tank structure, such as shown in U.S. Pat. No. 4,173,872 to Amthor.

However, we have discovered that in using such hot water tanks, which tanks are made from steel, in combination with a non-ferrous heat exchanger, such as a copper condenser, that galvanic processes occur between the steel of the tank and the copper of the condenser, which result in corrosive attack and penetration of the wall of the tank. This is particularly true when there is a small pinhole-type of perforation in the glass lining of the tank, such that the relatively large copper heat exchanger "sees" a very tiny steel element. The result of this is a highly concentrated attack on the small area of steel behind the pinhole in the glass.

In addition, we have found that the use of sacrificial anodes disposed within the tank and in the water within the tank are not sufficient to prevent rapid corrosion and deterioration of the tank wall. What is therefore needed is the outright prevention of such galvanic action.

BRIEF SUMMARY OF THE INVENTION

The present invention solves the galvanic problem by using dielectric, insulating bushings in openings provided in the wall of a metal tank or container to accommodate the metal heat exchanger. The bushings electrically and chemically insulate the heat exchanger from the metal wall of the tank. In addition, galvanic action problems can be solved by the use of a tank structure made of plastic or fiberglass materials. In this manner, no galvanic action can take place between the metal of the heat exchanger and the tank since the tank itself is an insulated structure.

In cases where potable water is not involved, or where plumbing codes permit such use with potable water, a single wall heat exchanger (condenser) can be used, thereby reducing the cost of the system. Double wall, leak detecting condensers are considerably more costly than a single wall structure, and can reduce heat transfer efficiency.

In order to make the use of heat sources sufficiently efficient and therefore economically viable for the ordinary household and for commercial use, we have found that certain structures and their orientation within the container or tank are required. For example, by placing the heat exchanger in a substantially vertical position within the tank, any unvaporized, i.e. any liquid "slugs" of a vaporizable refrigerant entering the heat exchanger will flow naturally from the heat exchanger by the force of gravity for return to the source of heat. Similarly, by placing the heat exchanger vertically within the tank and providing the heat exchanger with fins that extend vertically within the tank, convection currents within the tank that move the water past the heat exchanger are not impeded by the heat exchange and fin structures such that efficiency in the heat exchange process is enhanced.

THE DRAWINGS

The objectives and advantages of the present invention will be best understood from consideration of the following detailed description and the accompanying drawings, in which.

PREFERRED EMBODIMENTS OF THE INVENTION

Figure 1:
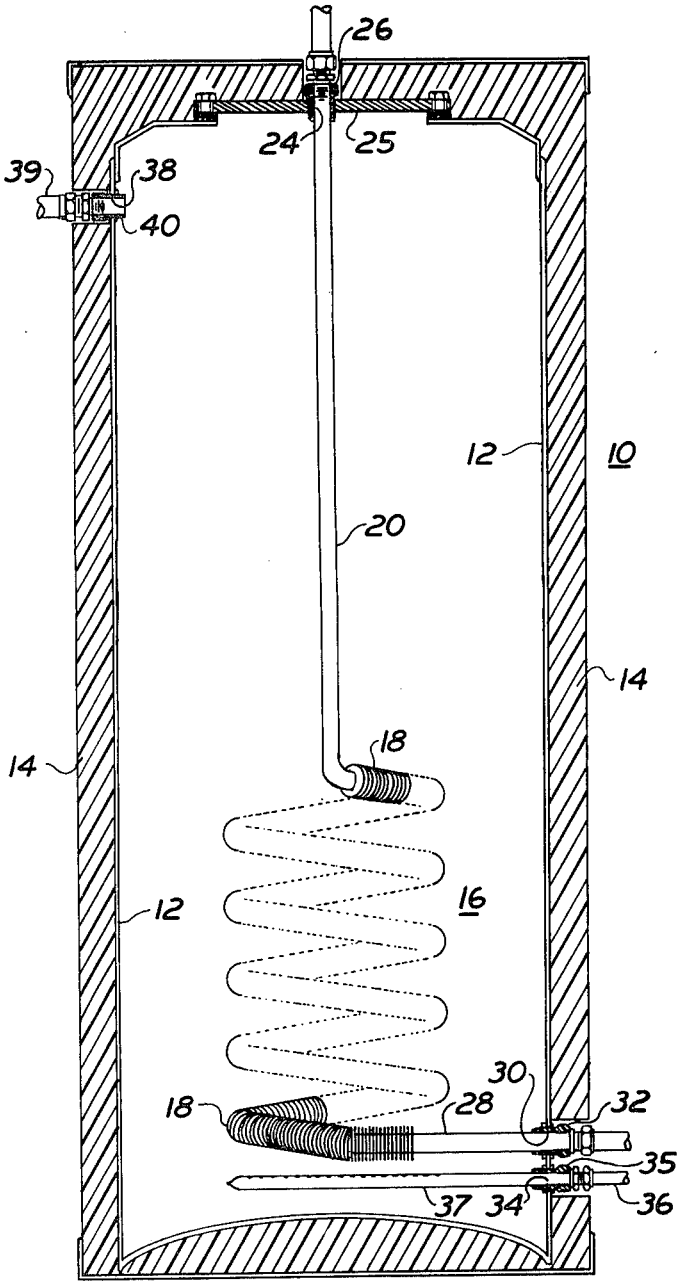
FIG. 1 is a vertical section of an insulated, glass-lined water storage tank having a heat exchange unit vertically disposed within the tank.
Figure 7:
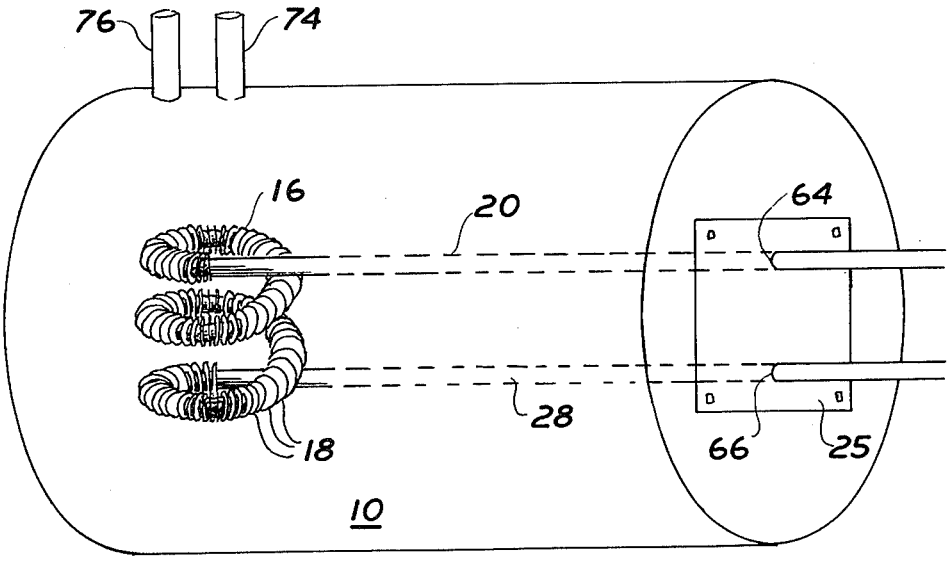
FIG. 7 is a schematic representation of another embodiment of a tank and heat exchange structure.

Referring now to the drawings, FIG. 1 thereof shows a tank or container 10 having a wall 12 for containing and storing water within the confines of the wall and tank. If the tank is a ferrous structure, the inside surface of wall 12 is provided with a thin coating of glass or other suitable materials (not shown) to protect the wall from rust and general deterioration. The outside of the container is surrounded by a layer of insulation 14 to limit heat loss through the glass-metal wall of the tank. If the wall 12 of tank 10 is an insulating material, insulating layer 14 may or may not be required, depending upon the particular material of the wall and tank. In addition, the configuration of tank 10 need not be that of FIGS. 1 and 2. Rather, the tank can be of any shape and be positioned in any suitable manner, such as shown in FIG. 7 of the drawings. The tank, of course, must have an inside dimension sufficient to receive and contain a heat exchange means, presently to be described.

Within tank 10 is a heat exchanging means 16 in the form of a helical tube structure vertically disposed in the lower region of the tank. On the outside surface of the helical tube structure are outwardly directed fins 18, which also extend in a vertical direction within the tank. For purposes of clarity, the major extent of the helical tube structure is shown without fins in the depiction of FIG. 1.

Figure 6:
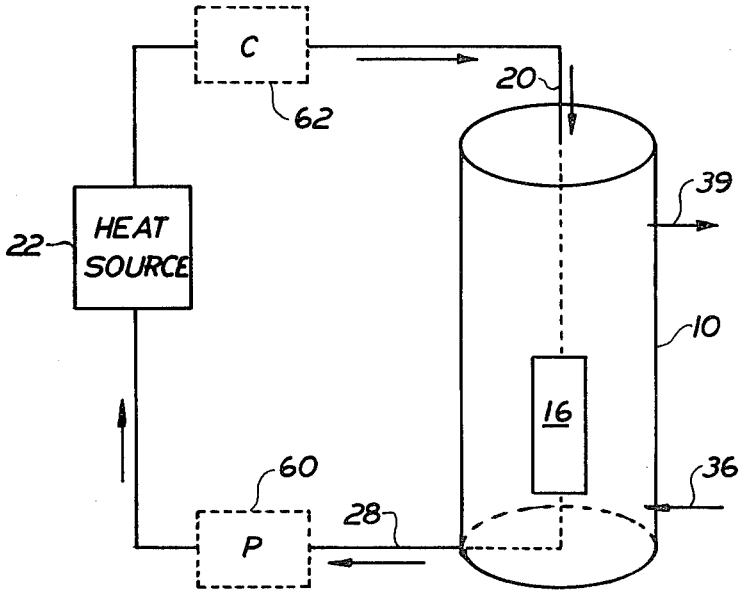
FIG. 6 is a schematic representation of the system of the invention.

An integral straight tube portion 20 connects the upper end of helical tube structure 16 to a source of heat 22 (see FIG. 6). Refrigerant is vaporized at the heat source 22 and eventually condensed in the heat exchanger 16 and hence its latent heat of condensation provides the basic heating mechanism. Suitable refrigerants include organic working fluids such as Freon. Tube portion 20 extends through an opening 24 provided in an upper wall portion and removable section 25 of the tank and through an insulating bushing 26 located in the opening, if the material of the tank wall 12 is metal.

Similarly, the lower end of heat exchanger 16 is connected to heat source 22 (and at a location opposite of the connection with tube 20) via a tube portion 28 extending through an opening 30 in the lower wall of tank 10 and through an insulating bushing 32 disposed in opening 30. Tube portion 28, like that of 20, is an integral extension of helical tube structure 16, without fins 18.

Figure 2:
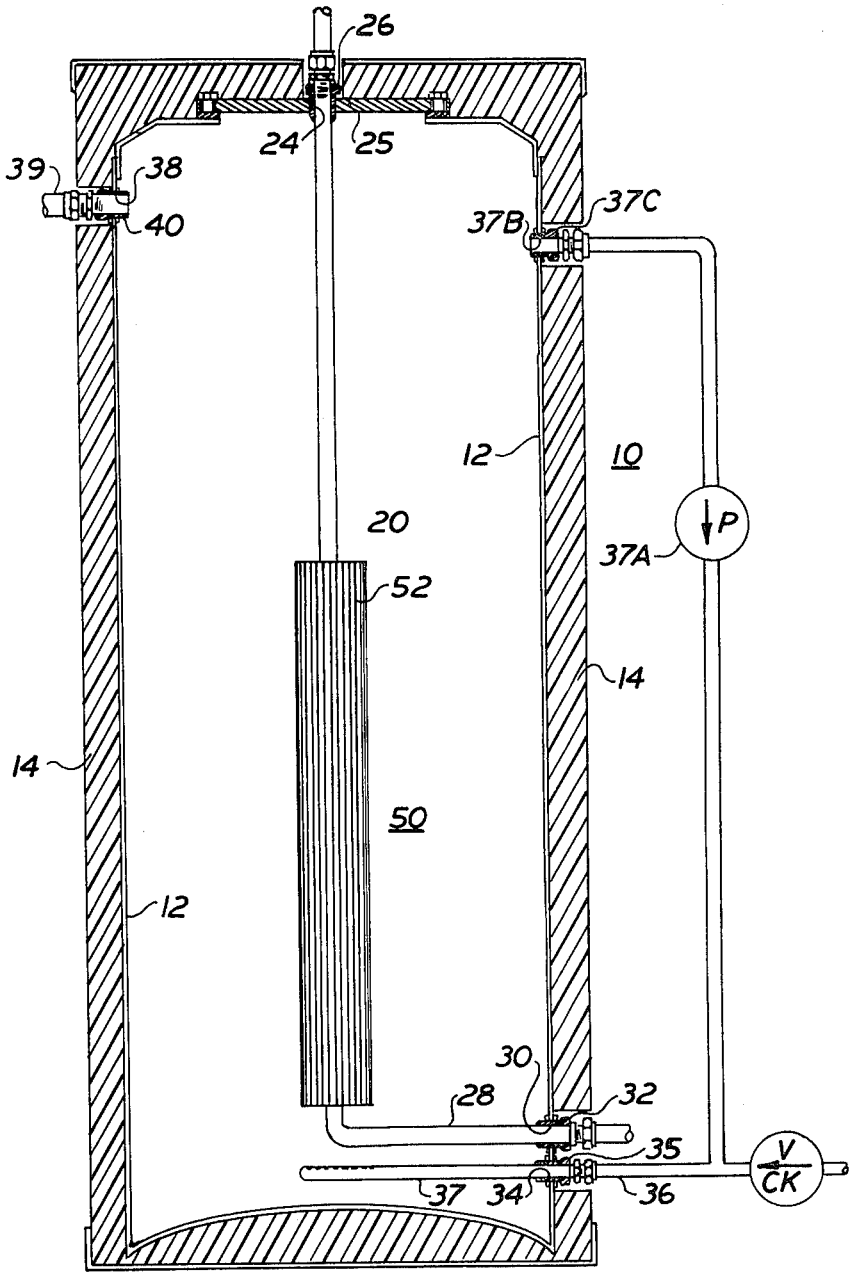
FIG. 2 shows the same tank structure but with a different type of heat exchange unit disposed vertically within the tank.

Another opening 34 is provided in the wall of tank 10 for the purpose of admitting water to the tank to be heated. In FIGS. 1 and 2 this opening is shown in the lower portion of the tank, though the entry of relatively cold water into the tank can take place at any appropriate location. An insulating bushing 35 is shown that separates a pipe 36, supplying cold water to the tank, from the tank wall. However, pipe 36 need not be insulated from the tank, as the size of the pipe in relation to the tank does not create a galvanic problem.

To improve convection movement of the water in the tank, pipe 36 is shown connected to a manifold device 37 in FIGS. 1 and 2, through which water is pumped by a pump means 37A from the upper region of the tank, manifold device 37 also being insulated from tank wall 12 by a bushing 34. Such a pump and manifold means require an additional opening 37B in the tank wall (FIG. 2). A bushing 37C is optional in 37B.

In an upper side wall portion of tank 10 is provided another opening 38, and a conduit 39, for withdrawing heated water from the tank. Again, an insulating bushing 40 is shown in this opening.

If tank 10 is an ordinary hot water storage tank using electrical heating elements to heat water in the tank, openings are provided in wall 12 of such a tank for the insertion of the electrical elements and for the connection of pipes to admit and remove water. The above insulating bushings (26, 32, 35 and 40) are inserted in these openings. The outside diameter of each bushing is sized to fit its respective opening (24, 30, 34 or 38) and is secured therein in a water-tight manner. The heat exchanger 16 or 50 is disposed in tank or container 10 through the upper wall thereof, i.e. upper wall portion 25 is a removable plate section for this purpose. The lower tube extension 28 of the heat exchanger has a length slightly less than the inside diameter of the tank such that 28 can be inserted through the opening of 25 and lowered into the tank to the level of opening 30 and bushing 32 provided in the side wall of the tank. 28 is then aligned with 30 and 32, and the heat exchanger moved toward the center of the tank, tube 28 thereby entering the opening of bushing 32. The size of the opening in bushing 32 is such that tube 28 is easily accepted therein, and to extend therethrough, the greater size of the bushing leaving a space between the bushing and tube.

With 28 in opening 30, plate section 25 with bushing 26 is slipped over tube extension 20, with the tube extension passing through the bushing. Tube extensions 20 and 28 are now ready to be sealed in the bushings in a water-tight manner.

Figure 4:
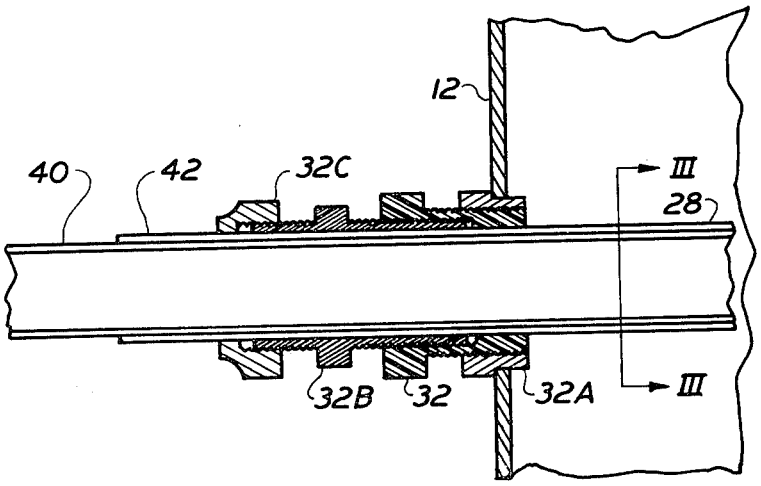
FIG. 4 is a longitudinal section of the double wall tube of FIG. 3 shown extending through the wall of the tank structure of FIGS. 1 and 2.

The tubes disposed in the openings provided in the wall of tank 12 can be sealed therein in a variety of ways. FIG. 4 of the drawings shows one such way, using tube extension 28 and bushing 32 as the example. After tube 28 is inserted through tank wall opening 30, and through a threaded metal spud 32A located in opening 30, as shown in FIG. 4, a Teflon bushing 32, as shown in FIG. 4, is threaded into the spud to fill the space between the tube and spud. The inside diameter of the spud is threaded to receive outside diameter threads of Teflon bushing 32. The inside diameter of 32 is also provided with threads to receive a metal bushing 32B having outside diameter threads. A nut 32C, capable of swaging bushing 32B against the outside surface of tube 28, is threaded on the exposed end of 32B to complete the seal of tube 28 in wall 12 of the tank in a water-tight manner. The combination of 32, 32B and 32C is given by way of example only, as other means can be employed to seal the tubing of the figures in the bushings of the figures.

Figure 3:
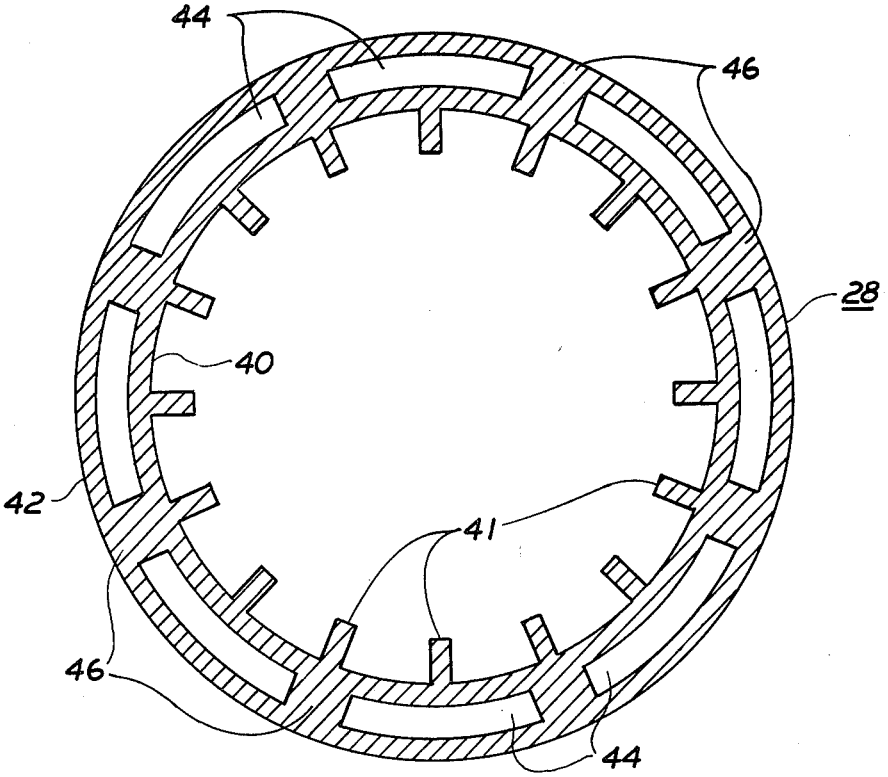
FIG. 3 is a cross-sectional view of a double wall tube structure taken along lines III—III in FIG. 4 and employable in the heat exchange units of both FIGS. 1 and 2.
Figure 9:
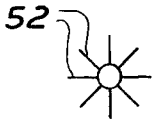
FIG. 9 is a cross-sectional view of a single wall, finned tube taken along lines IX—IX in FIG. 8.

FIG. 3 shows a cross section of a double wall tube structure for heat exchanger 16 and its extensions 20 and 28. 28 is shown extending through the wall of tank 10 in FIG. 4. However, a single wall structure is suitable where plumbing codes permit the use of single wall tubing and where potable water is not involved. FIG. 9 of the drawings shows a single tube.

More particularly, referring to FIG. 3, the heat exchanger is comprised of a first tube 40, having inwardly directed fins 41, all located within a second tube 42, of a diameter larger than 40, to provide an annular space 44. The annular space, however, is partially occupied by fins 46 that are in intimate physical contact with the two tubes. The space, or more correctly spaces 44, serve as means to detect the leakage of refrigerant and/or water into spaces 44 in the system of the invention, as the tubes and annular spaces extend to a location outside of the tank. This is best seen in FIG. 4. Any break or perforation in the inner tube 40 will admit refrigerant into one or more of the spaces 44, which refrigerant will then travel to the location outside of tank 10. Similarly, any break or perforation in the outer tube 42 will admit water into 44, which will again flow to the location outside of the tank.

This type of leak detection is known. What is surprising about the spaced-apart, double wall construction of FIGS. 3 and 4 is that it can conduct as much heat from the inner tube 40 to the outer tube 42 as that of a single tube, the wall of a single tube being, of course, in intimate contact with both the heated fluid and the fluid (water) to be heated. This is accomplished by providing fins 46 with a relatively large cross section so as not to impede the flow of heat.

The tube structure of FIGS. 3 and 4 can be made by a variety of processes, the processes forming no part of the present invention.

Figure 5:
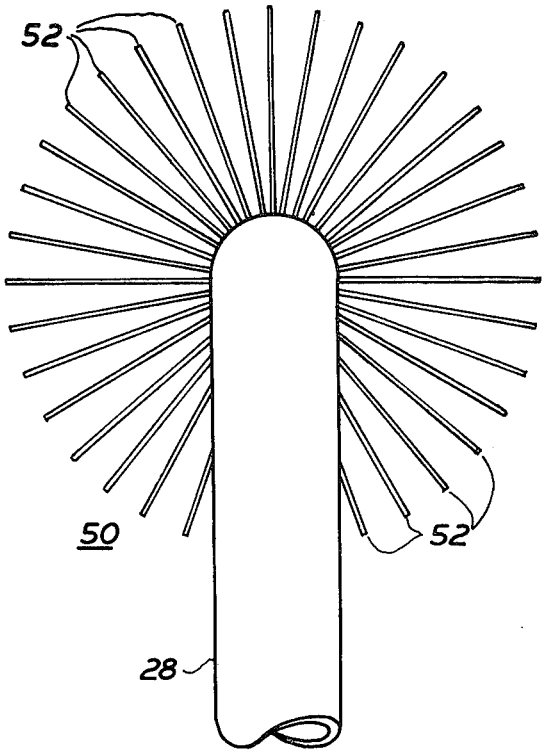
FIG. 5 is a bottom elevation view of the heat exchange unit of FIG. 2.

In the embodiment of FIG. 2 of the drawings, the heat exchange means within tank 10 is a straight, vertical, double wall tube structure 50 provided with outwardly directed fins 52 (FIG. 5) extending in the same vertical direction as tube structure 50. Tube structure 50 is otherwise the same as 16 in FIG. 1, i.e. tube structure 50 can be the double wall structure 20 depicted in FIG. 3 of the drawings or the single wall tube of FIG. 9, but having the fins 52 of FIG. 2. Similarly, like the heat exchanger 16 in FIG. 1, 50 is located in the lower portion of tank 10, though, as explained earlier, the configuration of the tank may be other than the relatively tall and narrow shape depicted in FIGS. 1 and 2.

The lower end of tube 50, like that of 16 in FIG. 1, is connected to heat source 22 (FIG. 6) via tube 28.

The operation of the system of the invention is described in terms of the schematic diagram of FIG. 6, with reference to the other figures as needed. Heat source 22 contains a refrigerant that is evaporated when the refrigerant receives heat energy and in the process the refrigerant is vaporized. In FIG. 6 of the drawings, the heated vapor is conducted via tube 20 to the upper end of heat exchanger 16 (or 50) in tank 10, which tank is substantially filled with water to be heated. Unheated, relatively cold water is supplied to the lower end of the tank via pipe 36 (FIGS. 1 and 2). In the tank, the water is in intimate contact with the fins 18 or 52 of the heat exchanger and with the outside surface of tube 42 (FIG. 3) of the heat exchanger. The refrigerant vapor is simultaneously in intimate contact with tube 40 of the heat exchanger. The refrigerant moves through tube 40 at a rate appropriate to allow the refrigerant to give up its heat to the wall of tube 40, which heat is conducted to the wall of tube 42 via fins 46 located between and in intimate contact with the tube walls. This heats the water in the tank, and in the process of giving up its heat to the water, the vapor condenses and is returned to 22. Any "slugs" of unvaporized fluid entering or forming in the heat exchanger 16 or 50 immediately fall through the inner tube 40 of the heat exchanger, under force of gravity, so that such slugs do not affect the efficiency of the heat exchange process.

The refrigerant can be directed through tube 40 of the heat exchanger 16 or 50 by normal flow of liquid due to gravity if the tank and heat exchange unit are located in a manner to gravity feed condensate from 16 or 52 to heat source 22, and the heat source is a solar collector. If the condensate from 16 or 50 cannot reach the solar collector under force of gravity, a pump 60, shown in dash outline in FIG. 6, can be used. If heat source 22 is the heat exchange device of an air conditioning or freezer unit, then a compressor 62 (in dash outline in FIG. 6) is required to direct the vapor from 22 to 16 or 50.

The unheated, relatively cold water entering into the bottom area of the tank, makes this area relatively cool with respect to the upper portion of the tank. The cold water in the vicinity of the heat exchanger 16 or 50 is, however, heated by the hot refrigerant in tube 40, and hence by the normal convection phenomenon, begins to move toward the upper portion of the tank through fins 18 or 52, i.e. in the manner in which heated air rises. The water already in the upper portion of the tank is displaced downwardly, traveling along the wall 12 of the tank remote from the heat exchanger. When this water reaches the bottom of the tank, it moves inwardly toward the heat exchanger and begins upward movement through the vertical fins 18 or 52 of the heat exchanger. This movement is not impeded by the heat exchanger, as the heat exchanger, including its fins, are disposed vertically in the tank. This, coupled with the fact that the heat of the refrigerant in tube 40 is transferred rapidly to 42 and the water about tube 42 and its fins, make the structure and process of the invention highly effective in heating and maintaining the heat of water directed to and contained in tank 10. For example, in using the refrigerant vapor produced in a five horsepower compressor of a dairy unit for cooling milk, with the vapor being at a temperature of 240° F., potable water in a 120 gallon, insulated steel tank can be maintained at approximately 120° F., with heated water being removed from the tank (via conduit 39) at a rate of 60 gallons per hour.

The system of the present invention does not require the use of sacrificial anodes in tank 10 to limit galvanic attack on the steel of the tank wall, as the dielectric, insulating properties of the bushings mounted in the tank wall insulate the tank wall from metal heat exchanger 16 or 50.

FIG. 7 shows an embodiment of the invention in which tank 10 is disposed in a substantially horizontal manner, in contrast to the tanks of FIGS. 1, 2 and 6. Like the heat exchanger 16 of the earlier figures, the heat exchanger in FIG. 7 is disposed in a manner that permits gravity to remove any uncondensed refrigerant from the heat exchanger.

In FIG. 7 heat exchanger 16 (using the numerals of the earlier figures to designate components that are common thereto) is a continuous tube structure in that finless extensions 20 and 28 of the heat exchanger extend through a side or end wall of tank 10 so that no mechanical connections of the fluid conducting structure are located within the tank. Upper and lower openings 64 and 66 are provided in a side wall of the tank to accommodate the extensions of heat exchanger 16. These openings can be provided in a plate 25, of the type described above in connection with FIGS. 1 and 2 of the drawings. Such a plate covers an opening in the side wall of the tank which permits the insertion and/or removal of the heat exchanger into and from the tank.

As in the heat exchange structures discussed earlier, the fins 18 on the heat exchange structure of FIG. 7 extend in a vertical direction so as not to impede the rise of heated water between and past the fins.

Figure 8:
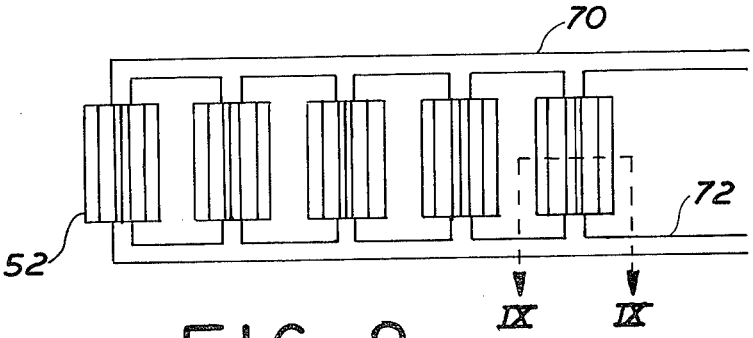
FIG. 8 shows a second heat exchange structure for use in the tank of FIG. 7.

Instead of the helical or coil structure shown in FIG. 7, FIG. 8 shows a heat exchange structure in which a plurality of vertically disposed tubes are connected together in a parallel manner by and between two horizontal tubes 70 and 72. 70 and 72 connect the plurality of vertical tubes to a source of heat through respectively the upper and lower openings 64 and 66 in plate 25 (of FIG. 7). Each of the vertical tubes in FIG. 8 are provided with a plurality of fins 52 radially extending from the outside surfaces of the tubes, the fins, in addition, extending along the axis of each tube so that the fins are located in the tank in a vertical manner.

FIG. 9 shows a cross section of a heat exchanging tube that can be used in the structure of FIG. 8, as well as in the structures of FIGS. 1 and 2. It will be noted that the tube is a single wall structure, which is less expensive than the double wall structure of FIG. 3. A single wall tube can be used where the heating of potable water is not involved or where plumbing codes permit the use of single wall tubing with potable water.

Water can be fed to and removed from the tank of FIG. 7 in an appropriate manner, such as the two pipes or tubes 74 and 76 connected in appropriate openings provided in the wall of the tank.

While the invention has been described in terms of preferred embodiments, the claims appended hereto are intended to encompass all embodiments which fall within the spirit of the invention.

What is claimed is:

1. A container construction and combination including the following components and structure:

a horizontally disposed container having a wall structure for confining a fluid to be heated in the container, an upper and a lower opening provided in a side wall of the container, a metal heat exchanger disposed within the container, and in a manner that permits the force of gravity to remove condensed refrigerant from the heat exchanger, the heat exchanger being comprised of a tube structure provided with fins extending outwardly from the outer surface of the structure and vertically within the container, the tube structure of the heat exchanger having two tube portions extending respectively through the two openings provided in the side wall of the container, such that the ends of said portions are located outside the container, and insulating bushings located in the upper and lower openings to free the combination of corrosive galvanic action between the components thereof when the fluid to be heated is present in the container.

2. The combination of claim 1 in which the tube structure of the heat exchanger is a single wall structure.

3. The combination of claim 1 in which the heat exchanger is a spiral coil of tubing, the axis of the coil extending vertically within the horizontal container.

4. The combination of claim 1 in which the heat exchanger comprises parallel tubes extending vertically within the tank, and tubes disposed horizontally in the container and connected in fluid communication with the ends of the vertical tubes.

5. In a system for utilizing a source of heat to heat water in a horizontally tank, the system including:

a source of heat in which a liquid refrigerant is vaporized in the process of being heated, a horizontal tank structure provided with upper and lower openings in a side wall thereof, metal means located within the tank structure for heating water by condensing vaporized refrigerant, said means comprising a tube structure having fins extending in a vertical direction within the tank, the tube structure having an upper and lower end, tube means located in said upper opening connecting the upper end of the tube structure in fluid communication with the source of heat, said means being capable of conducting vaporized refrigerant from the source to the upper end of the tube structure, tube means in said lower opening connecting the lower end of the tube structure to the source of heat for returning refrigerant condensed in the tube structure to the source of heat, an opening provided in a wall portion of the tank structure for removing heated water from the tank, and yet another opening provided in the structure for admitting water to be heated into the tank, and means to insulate the tube structure for condensing vaporized refrigerant from the wall of the tank structure so that the system is free of corrosive galvanic action when water is present in the tank structure.

* * * * *